United States Patent [19]

Amos et al.

[11] Patent Number: 4,658,728

[45] Date of Patent: Apr. 21, 1987

[54] PROJECTILES

[75] Inventors: Leonard J. Amos, Crowborough; John T. Heron, Tonbridge, both of England

[73] Assignee: The Secretary of State for Defence in Her Britanic Majesty's Government of the United Kingdom of Great Britain and Northern Ireland, London, England

[21] Appl. No.: 790,809

[22] Filed: Oct. 25, 1985

Related U.S. Application Data

[63] Continuation of Ser. No. 5,392, Dec. 28, 1978, abandoned.

[30] Foreign Application Priority Data

Dec. 29, 1977 [GB] United Kingdom ..... 54200/77

[51] Int. Cl.[4] ..... F42B 15/00; B32B 15/08; B32B 27/38

[52] U.S. Cl. ..... 102/501; 428/416; 428/920

[58] Field of Search ..... 102/513, 515, 517, 501; 428/416, 920

[56] References Cited

U.S. PATENT DOCUMENTS

| | | | |
|---|---|---|---|
| 2,786,794 | 3/1957 | Gams et al. | 428/416 X |
| 3,115,271 | 12/1963 | Anderson et al. | 220/83 |
| 3,750,585 | 8/1973 | Feldman | 102/513 |
| 3,910,194 | 10/1975 | Dehm et al. | 102/527 |
| 4,001,126 | 1/1977 | Marion et al. | 252/62 |
| 4,079,168 | 3/1978 | Schwemmer et al. | 428/416 |

FOREIGN PATENT DOCUMENTS

| | | |
|---|---|---|
| 160242 | 12/1954 | Australia . |
| 255219 | 11/1964 | Australia . |
| 2223477 | 11/1973 | Fed. Rep. of Germany . |
| 1219149 | 5/1960 | France . |
| 1230314 | 9/1960 | France . |
| 397582 | 12/1976 | Sweden . |
| 559204 | 2/1944 | United Kingdom . |
| 920921 | 3/1963 | United Kingdom . |
| 963490 | 7/1964 | United Kingdom . |
| 997895 | 7/1965 | United Kingdom . |
| 1004724 | 9/1965 | United Kingdom . |
| 1148431 | 4/1969 | United Kingdom . |
| 1176349 | 1/1970 | United Kingdom . |
| 1243637 | 8/1971 | United Kingdom . |
| 1243636 | 8/1971 | United Kingdom . |
| 1262527 | 2/1972 | United Kingdom . |
| 1448086 | 9/1976 | United Kingdom . |
| 1448087 | 9/1976 | United Kingdom . |

OTHER PUBLICATIONS

*Ablation,* Donald L. Schmidt, Chapter 13, "Engineering Design for Plastics".

*Ablation,* I. J. Gruntfest in Kirk & Othmer, "Encyclopedia of Chemical Technology", vol. 1, 2nd ed. (1963).

*Epoxy Powder Coatings,* pp. 73–85.

*Primary Examiner*—Richard D. Lovering

*Attorney, Agent, or Firm*—Cushman, Darby & Cushman

[57] ABSTRACT

A projectile component is provided with a thermally ablative coating capable of giving complete protection against the erosive effects of in-bore and in-flight heating, with minimal impairment of aerodynamic performance.

5 Claims, 1 Drawing Figure

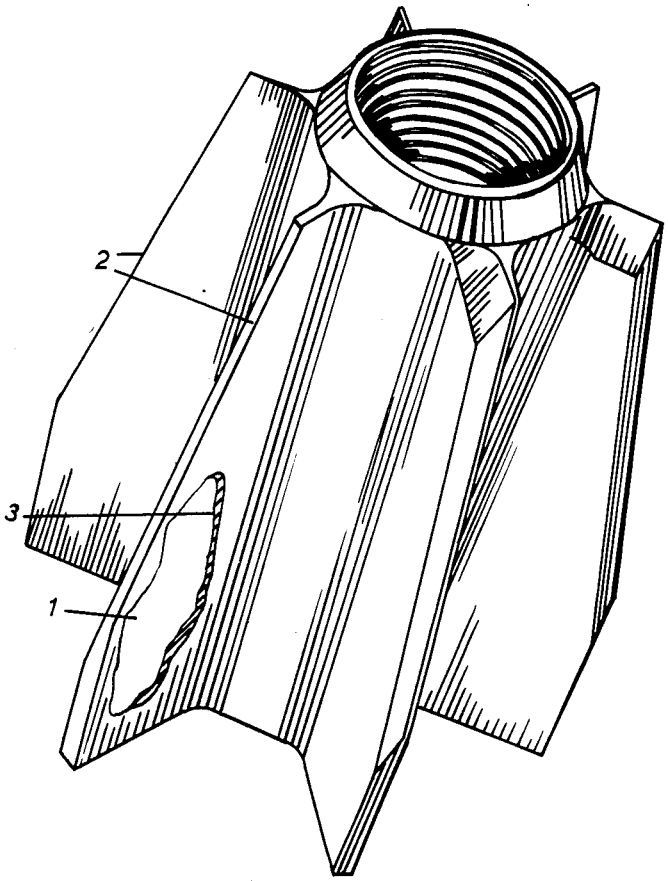
2
3
1

PROJECTILES

This is a continuation of application Ser. No. 005,392, filed Dec. 28, 1978, which was abandoned upon the filing hereof.

This invention relates to projectiles and the protection of their exterior surfaces against thermal erosion. In particular, but not exclusively, it relates to fin stabilized, kinetic energy projectiles.

Projectiles fired from a gun by means of a propellent charge are subject to in-bore damage due to high propellent flash temperatures at their propellent adjacent surfaces. This is particularly harmful when lightweight stabilizing tail fins of aluminum alloy are fitted, as any significant damage to the fins will result in degradation of the aerodynamic performance of the projectile. Furthermore, the leading edges of the fins are also subject to substantial aerodynamic heating in flight, resulting in possible further performance degradation. Attempts have been made to protect the outer surface of such fins by anodizing, but this has not proved effective against thermal erosion. Thermally insulating coatings of ceramic type have also been tried but these present adhesion problems and the layer thickness required tends to distort the aerodynamic characteristic of the fins.

Heat absorbent coatings such as coatings containing intumescent materials, are also known for their thermally protective properties, but these too have poor adhesion and also undergo dimensional changes in operation which degrade the aerodynamic performance of a finned projectile.

Another example of a heat absorbent coating is that of an ablative heat shield, ie. a sacrificial layer of material which is gradually removed by thermally induced processes eg. pyrolysis, melting and vaporisation. Such heat shields are known for the protection of space vehicles at re-entry to the earth's atmosphere for example and are generally formed from plastics composites having a fairly high fibre content, and often include intumescent materials. The composites are usually applied to the relevant surface either as bonded pre-formed layer or in fluid form by trowelling or casting. Such protective layers are thick and heterogeneous, ablate unevenly and consequently would have the effect of adversely distorting the aerodynamic profile of a precise structure such as the fins of a projectile, both initially and variably during flight.

The present invention seeks to provide a projectile component with a relatively thin, homogeneous heat absorbent coating that will not impair aerodynamic performance.

Accordingly, the present invention comprises a projectile component having a thermally ablative outer layer formed from a resinous material.

Preferably the resinous material is heat-curable and applied to the component prior to curing. Application may be conveniently made by immersing the pre-heated component in a finely divided mass of the uncured resinuous material, which mass may be suspended in a fluid e.g. a liquid or a flowing gas.

The outer layer is selected to be of minimum thickness sufficient only to absorb the total amount of heat expected to be received during firing and flight, thereby degrading the aerodynamic profile as little as possible.

When the projectile component is intended for use adjacent a propellent charge, the resinous material must be compatible with the propellent and may comprise an epoxy resin based material with or without fillers.

An embodiment of the invention will now be described by way of example only, with reference to the accompanying drawing which is of a tail fin unit for a kinetic energy projectile, having a part-cutaway outer layer.

The specific fin unit 1 of this example is fabricated from aluminum alloy having a melting point of about 600° C. and is subject to in-bore flash temperatures of up to 3,000° K. for a period of approximately 3 mS and subject thereafter to in-flight aerodynamic heating for a period dependent upon flight range, of up to 3 S. In a normal operating range flight of 1.2 S the temperature of the leading edges 2 of the fins will rise to about 1,500° K. Thus, the tail fin unit is subjected, in use, to temperatures greater than its own melting point.

A protective layer 3 is applied to the fin unit as follows. The unit is first grit-blasted to ensure a finely abraded surface and the pre-heated to the curing temperature of a suitable resinous material. An epoxy resin powder of grist size small enough to pass through a 72 mesh BS sieve and having a curing temperature of approximately 180° C. is suitable for this embodiment, and a partially esterified diglycidyl ether of bisphenol A (DGBA) such as one normally used for weather proofing metal objects has been found satisfactory, for example, Telcoset (Registered Trade Mark) type 606B Green 29.

The pre-heated fin unit is immersed and continuously agitated in a fluidized bed of the resin powder for a controlled period dependent upon the layer thickness required and then removed and cured for a further 20 minutes at 180° C. A layer thickness of 350 to 400 μm has been found satisfactory and this can be achieved with an immersion period of approximately 5 S.

The resulting layer is smooth and uniform, has good adhesion with minimal deformation of the fin profile and provides particularly inexpensive and effective protection. It also has good resistance to chipping.

It will be apparent that other heat-curable resinous materials having suitable heat absorbent and ablative properties can be similarly applied to various projectile components in accordance with the invention.

We claim:

1. A projectile tail fin unit subject, in use, to temperatures greater than its own melting point having a heat-absorbent external coating comprised entirely by a substantially homogeneous, thermally ablative layer of a heat-cured resinous material that has been formed directly upon said unit by a heat-curing process subsequent to application of the resinous material in an uncured state, which layer is of a uniform thickness selected to be sufficient only for absorbing the total amount of heat received during both firing and flight of said fin unit, thereby to ensure minimal degradation of the aerodynamic profile of said fin unit.

2. A projectile tail fin unit as claimed in claim 1 wherein said resinous material is epoxy resin based.

3. A projectile tail fin unit as claimed in claim 2 wherein said epoxy resin is a diglycidyl ether of bisphenol A.

4. A projectile tail fin unit as claimed in claim 1 wherein the homogeneous layer is of thickness less than 1 mm.

5. A projectile tail fin unit as claimed in claim 1 wherein said resinous material in incured state is in finely divided form and application is achieved by immersing the unit, pre-heated to the curing temperature of the resinous material, in a fluid suspension thereof.

* * * * *